United States Patent [19]

Richards

[11] 4,381,111

[45] Apr. 26, 1983

[54] GOLF SWING SIMULATOR DEVICE

[76] Inventor: Ralph H. A. Richards, 20 Homestead Gardens, Frenchay, Bristol, BS16 1PH, England

[21] Appl. No.: 289,174

[22] Filed: Aug. 3, 1981

[30] Foreign Application Priority Data

Aug. 6, 1980 [GB] United Kingdom ..... 8025584

[51] Int. Cl.[3] ..... A63B 69/36

[52] U.S. Cl. ..... 273/191 R; 273/81.2; 273/194 R

[58] Field of Search ..... 273/191 R, 191 A, 191 B, 273/192, 186 R, 186 A; 434/252

[56] References Cited

U.S. PATENT DOCUMENTS

| | | | |
|---|---|---|---|
| 1,983,920 | 12/1934 | Perin | 273/191 R |
| 2,299,781 | 10/1942 | Adams | 273/191 R |
| 2,458,932 | 1/1949 | Cottingham | 273/191 R |
| 2,472,065 | 6/1949 | Cottingham | 273/191 R |
| 3,876,212 | 4/1975 | Oppenheimer | 273/186 R |

FOREIGN PATENT DOCUMENTS

| | | | |
|---|---|---|---|
| 587140 | 4/1947 | United Kingdom | 273/191 R |
| 1009090 | 11/1965 | United Kingdom | 273/191 R |
| 1144180 | 3/1969 | United Kingdom | 273/191 R |
| 2039221 | 8/1980 | United Kingdom | 273/191 R |

*Primary Examiner*—George J. Marlo

*Attorney, Agent, or Firm*—Larson and Taylor

[57] ABSTRACT

A golf swing simulator comprises a handle (10) pivotally connected about an axis (28) to an arm (20), which in turn is pivotally connected about an axis (26) to a mounting (14,15,16). The mounting includes two parts (14,16) which are adjustable to vary the angle of the axis (26) to the horizontal. The connection between the handle (10) and the arm (20) is via a crank (22), pivot axis (28) and means (132,133) for adjusting the angle of the axis (28) relative to the axis (26). This latter angular adjustment is centered about the point of intersection (X) of the pivot axis (28) with the longitudinal axis (34) of the handle.

7 Claims, 7 Drawing Figures

GOLF SWING SIMULATOR DEVICE

Figure 1:
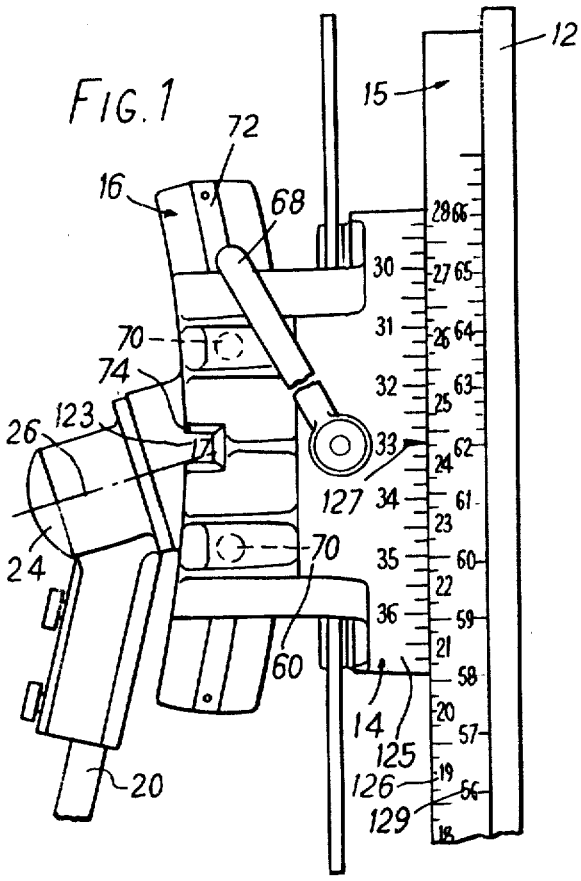

This invention relates to equipment for practising the game of golf. More particularly it relates to the golf swing simulator disclosed in my U.K. Patent Application No. 7939089 (Publication No. 2039221).

That Application disclosed a golf swing simulator device comprising a handle or mounting for a handle representing that of a golf club, attachment means for mounting the device to a stationary support, and a linkage connecting the handle with the attachment means, the linkage comprising an arm pivotally mounted at one end to the attachment means about a first axis, the arm extending away from said axis so that on pivoting the other end of the arm describes a circle about said first pivot axis, a crank one end of which is connected with said other end of the arm through a pivotal connection having a second axis of rotation preferably co-planar with but spaced from said first axis and the other end of which is rotatably mounted to the handle about the longitudinal axis of the handle so that the handle projecting from the crank is spaced from said pivotal connection in line with said second axis, means for adjusting the effective length of the arm, means for adjustment of the angle that said first pivot axis makes with the horizontal, and means whereby the angle between said first and second axes can be adjusted.

The present invention in one aspect is characterised in that the means whereby the angle between said first and second axes can be adjusted is adapted to act about a centre which is in the region of the handle, preferably on its longitudinal axis.

In a further aspect of the invention said attachment means comprises a first component for fixing to the stationary support and a second component vertically adjustably mounted to said first component and to which said arm is pivoted, a first upright scale on one of said components representing the standing height of the club, a second upright scale on the other of said components alongside the first scale being proportional to and representing the user's own effective arm measurement, said arm of the simulator being also provided with a lengthwise scale proportional to and representing the user's own effective arm measurement; whereby in setting up the simulator for use said second component is adjusted on said first component so that the reading representing the user's own effective arm length and the reading representing the desired club standing height are coincident on said first and second scales, and the effective length of the simulator arm is adjusted to the reading on said arm scale representing the user's own effective arm length.

In a third aspect of the invention, a first angle scale indicates the angle setting of the first axis, a second angle scale indicates the angle setting of the second axis, the two angle scales being arranged so that for a given lie angle of the club the difference between their respective readings is constant irrespective of the actual angle settings of the first and second axes, said difference representing an angle index value for that lie angle, whereby on setting up the simulator for use, the first axis is adjusted to a desired angle setting, the index value for the desired lie angle is added to or subtracted from the reading of the first angle scale, and the second axis is adjusted to show the resultant value on the second angle scale.

In a fourth aspect of the present invention, the means for mounting the device to a stationary support comprises a pair of side plates adapted to be secured to a said support, and a block adjustably disposed between the side plates, the block and the plates having a series of holes each disposed along a similar arcuate locus, the holes being arranged so that at least two holes of the block and the plates are coincident at each of a number of different angular settings for the block between the plates, whereby the block can be secured to the plates at any of said positions by passing a pair of pins through the registering holes.

In yet another aspect of the present invention the means for mounting the device to the stationary support comprises a channel-shaped bracket adapted for mounting to a said support and a block adjustably disposed within the bracket and pivotally carrying said arm, the sides of the block being provided with arcuate grooves and the sides of the channel being provided with mutually inwardly directed projections which engage the grooves so as to guide the adjustment of the block relative to the bracket along an arcuate path, one side member of the bracket being movable towards and away from the opposite side member of the bracket, and means being provided for effecting such movement whereby the block can be alternatively clamped and released within the bracket.

Figure 2:
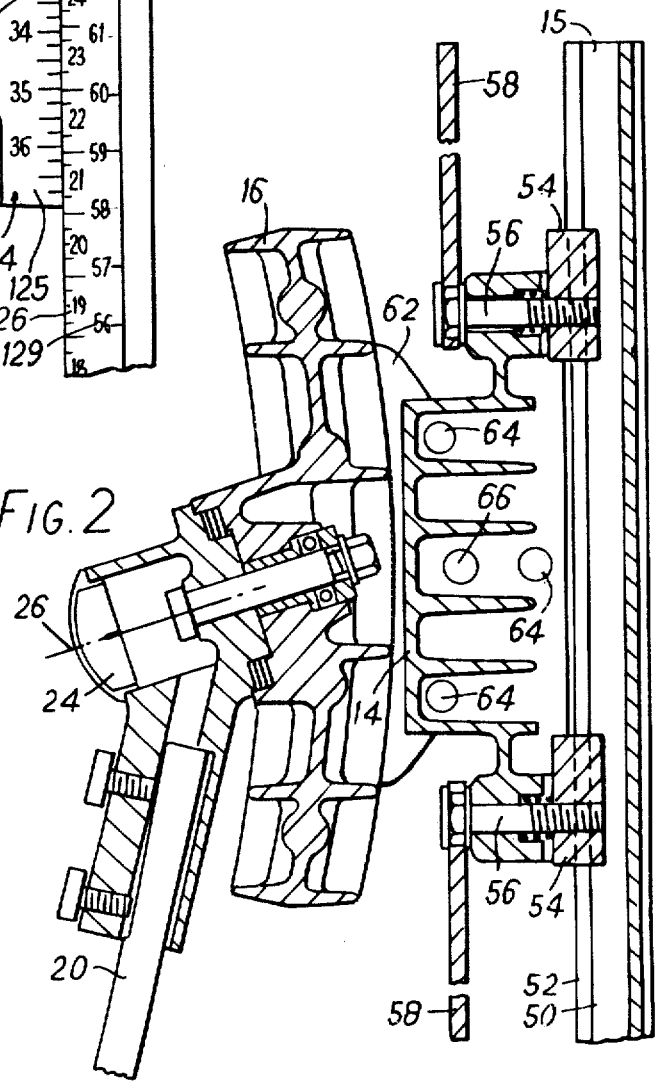
Figure 3:
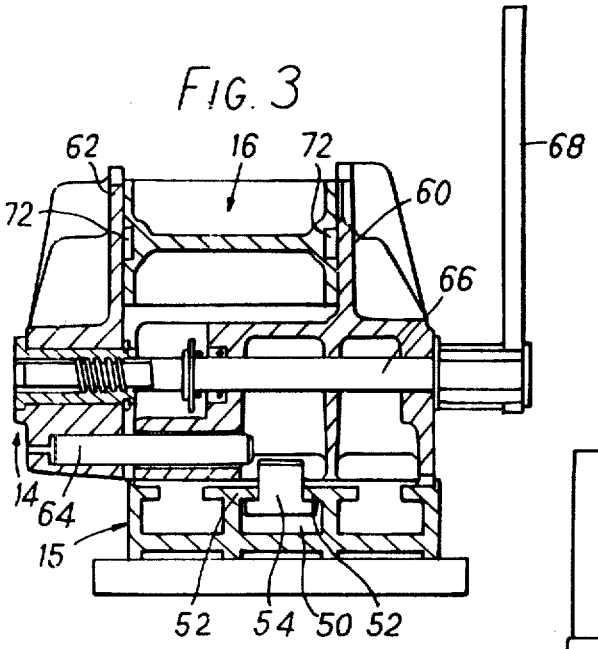
Figure 4:
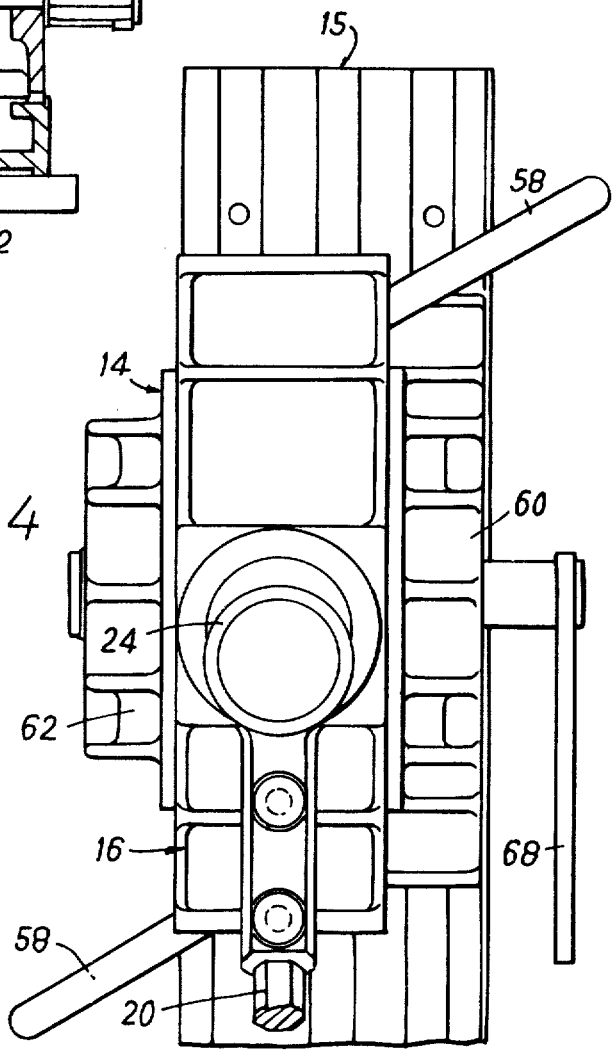
Figure 5:
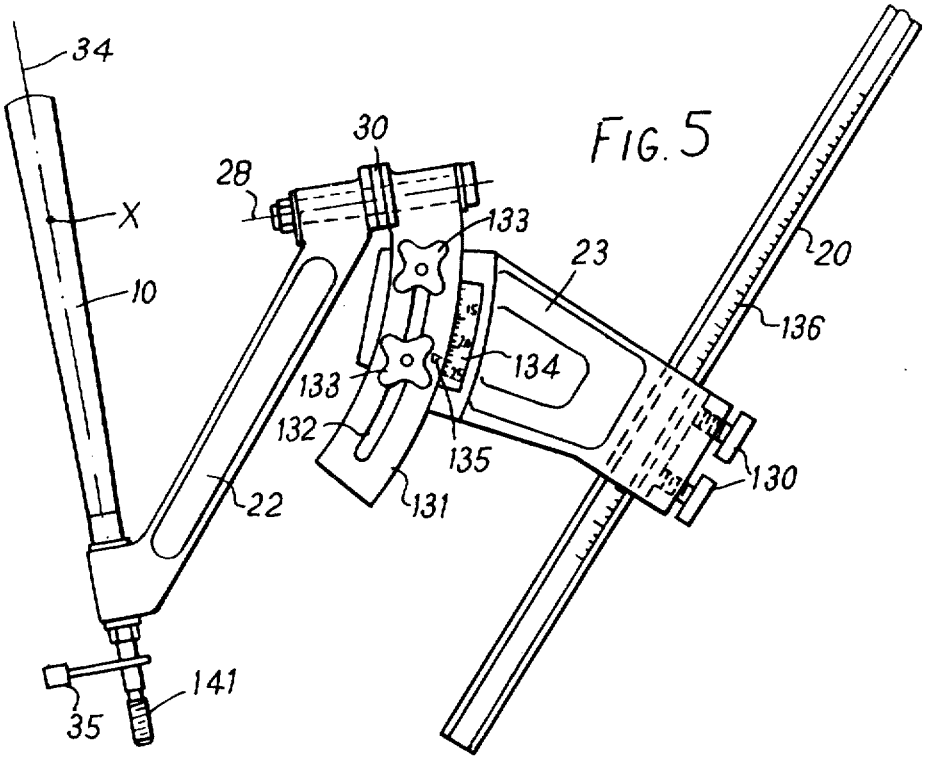
Figure 6:
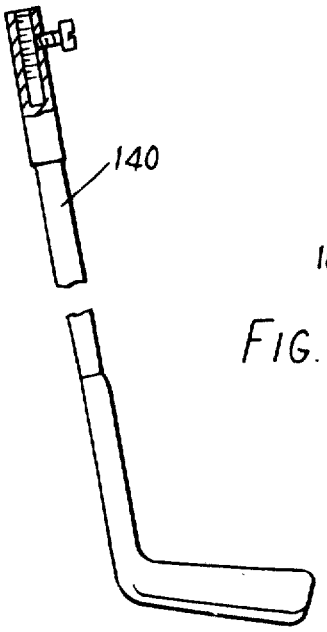
Figure 6:
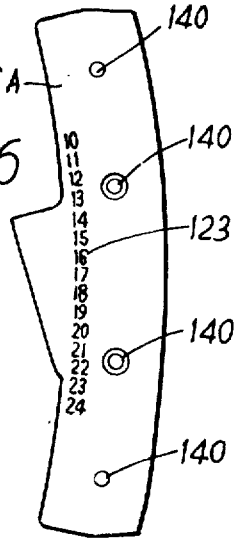
Figure 7:
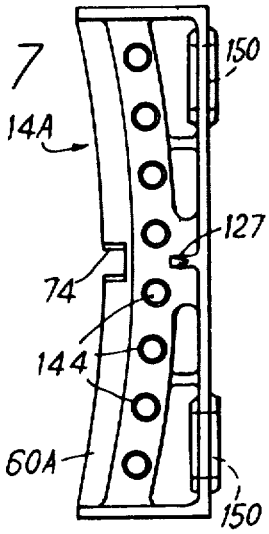

In order that the invention may be more clearly understood, various embodiments will now be described with reference to the accompanying drawings, wherein:

FIG. 1 shows a side view of the wall mounting region of one embodiment of device, FIG. 2 shows the same view as FIG. 1 but in vertical cross-section, FIG. 3 shows a transverse cross-section through the embodiment of FIG. 1, FIG. 4 shows a front view of the wall mounting region of FIG. 1, FIG. 5 shows a side view of the handle region of the device, FIG. 6 shows a side view of the block used in the wall mounting region, modified for an alternative embodiment with a different method of mounting, and FIG. 7 shows a side view of one of a pair of side plates suitable for use with the modified block of FIG. 6.

The general principles of construction and operation of the device are similar in many respects to that described and illustrated in FIGS. 1 and 2 of my U.K. Patent Application No. 7939089 (Publication No. 2039221). There are, however, certain important differences.

Referring to FIGS. 1 to 4; a head 24 at one end of an arm 20 is journalled about an axis 26 to a block 16 which is adjustably mounted in a bracket 14, which in turn is adjustably mounted to a slide plate 15 to be secured to a fixed support such as a wall 12. The slide plate has a longitudinal channel 50 whose mouth is restricted by inturned lips 52, as shown in FIG. 3. Upper and lower T-bolts 54 are retained in the channel by the lips, and the projecting portions of the T-bolts are carried on screws 56 (see FIGS. 2 and 3) extending through the bracket 14 and rotatable by levers 58. Thus, movement of the levers in one direction draws the T-bolts towards the bracket 14 and thereby clamps the lips 52 and secures the bracket in the desired position to the slide plate 15. Movement of the levers in the other direction slackens the T-bolts so that the bracket can be moved up and down the slide plate.

The block 16 is located between two parallel walls 60,62 of the bracket, the wall 62 being separate from the rest of the bracket and carried on slide pins 64 and a screw shaft 66 which passes through the bracket and is connected to a lever 68. Thus, movement of the lever draws the wall 62 towards the wall plate 60 in the manner of a vice, clamping the block 16 in the desired position. A pair of pins 70 on the inside face of each wall 60,62 engage arcuate grooves 72 in the sides of the block 16, so that movement of the block relative to the bracket is constrained to follow a similar curved path. One side of the block is marked with a scale 123 consisting of a series of numbers, as can be more clearly seen in FIG. 6, which appear individually in a recess 74 in the wall 60 of the bracket. The number appearing in the recess represents the angle, in degrees, of the axis 26 relative to the horizontal. Each groove 72 may, if desired, be provided with a short branch at one point into which one of the pins can be engaged so as to bring the axis 26 directly into the horizontal position, which may be useful for putting practice.

For vertical height adjustment of the bracket 14 on the slide 15, two scales 125,126 are provided on the bracket and the slide plate respectively. The scale 125 on the bracket 14 represents the club standing height measurement. The scale 126 on the slide plate is proportional to and represents the user's arm measurement. In addition, there may be a mark 127 at the centre of the bracket, and on the slide plate there may be provided a scale 129 which indicates the true height above the ground.

At the free end of the arm 20 is provided a handle as shown in FIG. 5. Considering this region; a handle 10 is rotatably mounted about an axis 34 to a crank 22, which is in turn connected by pivot 30 to an arcuate plate element 131, so that the crank 22 is pivotable relative to the plate 131 about the axis 28 of the pivot 30. The plate element 131 has an arcuate slot 132 through which a pair of screws 133 pass to clamp it adjustably to a connecting element 23 which is longitudinally adjustably mounted on the free end portion of the arm 20 by means of clamping screws 30. A scale 136 is provided on the arm 20 to indicate the position of the connecting element 23, and this scale is proportional to and represents the user's arm measurement. The arcuate slot has a centre of curvature which lies in the region of substantially the handle, preferably on the axis 34 of the handle 10. The location of this point, indicated at X in FIG. 5 enables the lie angle of the handle to be adjusted without upsetting the geometry of the rest of the equipment, and also provides a datum point from which the geometry of the equipment can be designed. The angular adjustment of the plate 131 is indicated on a scale 134 on the connecting element 23 by a mark 135 on the element 131. The axis 28 should intersect the handle at the point about which the hands break naturally during the swing. In practice, a suitable location for this point has been found to be about 7 cm from the top end of the handle.

In use, the equipment is set up as follows. Initially the slide plate 15 is fixed to the wall or other support at a specific height so that the scale 129 represents the true distance above the ground. This is important in order that the scales 125 and 126 can be used properly. The rest of the apparatus is then mounted on the slide plate.

A preliminary assessment of a suitable swing plane for the user is made, having regard to his build. His arm length is measured in the approved manner to determine the swing radius, and a decision is made as to which club the user wishes to practice with. An appropriate club shaft 140 can be fitted to the projecting stem 141 of the handle if desired, or a finger 35 can be provided on the handle to show the angular position of the club head during the swing. Even if a club shaft is not provided the club selection must still be made in order to decide the lie angle and standing height, which varies with different clubs. The figures normally used by manufacturers are as follows.

TABLE

| Club | Standing Height | Lie Angle | Index for Scale |
|---|---|---|---|
| DRIVER | 876 mm | 55° | 0 |
| 3 WOOD | 825 mm | 56° | 1 |
| 2 IRON | 819 mm | 57° | 2 |
| 3 IRON | 819 mm | 58° | 3 |
| 4 IRON | 813 mm | 59° | 4 |
| 5 IRON | 813 mm | 60° | 5 |
| 6 IRON | 813 mm | 61° | 6 |
| 7 IRON | 806 mm | 62° | 7 |
| 8 IRON | 800 mm | 63° | 8 |
| 9 IRON | 800 mm | 64° | 9 |
| PUTTER | 857 mm | 78° | 23 |

In practice a club may be used at a different lie angle, which will affect the standing height, but the relationship between the actual lie angle and the index for the scale remains the same.

The swing plane is set by adjusting the block 16 in the bracket 14 so that the appropriate angle chosen for the swing plane axis 26 appears in the recess 74. The bracket 14 is adjusted vertically on the slide plate 15 so that the value for the club standing height, as indicated on the scale 125, lies opposite the value for the user's arm measurement, as indicated on the scale 126. It should be noted that while the club standing height is a vertical measurement, so that the scale 125 is a true scale, the user's arms during practice slope downwardly so that the variations in users'arm lengths appear smaller when measured in the vertical direction. Thus, the scale 126 is not a true scale but is proportional to a true scale by a factor representing the anticipated angle of slope of the user's arms.

The handle connecting element 23 is adjusted on the arm 20 to the setting on the scale 136 corresponding to the user's arm measurement; this adjustment of course determining the radius of swing about the axis 26. Again, since the direction of the arm 20 is not parallel to the direction of the user's arms, the scale 136 will not be a true scale but will be proportional to a true scale by a factor depending on the angular relationship between the user's arms and the arm 20.

Next, the handle 10 has to be set to give the correct lie angle for the club. This is done by adjusting the plate 131 on the connecting element 23. However, since the angular position of the plate 23 depends upon the initial angular setting for the axis 26, the scale 134 cannot give directly the lie angle. Instead, the value indicated on the scale 134 has to be set to a figure which combines the value for the lie angle and the value for the angular setting of the axis 26. This is done by adding to the figure which appears in the recess 74 the index figure given in the above Table for the appropriate lie angle, and setting the plate 131 to the resultant figure on the scale 134. Thus, if a new swing plane is selected later on, so that a different figure appears in the recess 74, the resulting change in the lie angle can be restored to its correct value simply by adding the lie angle index to the new reading in the recess 74 and adjusting the scale 134 to the new figure. Because the plate 131 is adjusted about the point X on the handle, such adjustments have minimal effect on the position of the handle and thus should not require resetting of the entire equipment.

Referring now to FIGS. 6 and 7; the block 16A in FIG. 6 takes the place of the block 16 in FIG. 1, and the bracket 14A in FIG. 7 takes the place of the bracket 14 and slide plate 15 in FIG. 1. The block 16A is essentially similar to the block 16 of FIG. 1, except that instead of having arcuate channels 72, four transverse passages 140 are provided along the same arcuate locus as the grooves 72. The bracket 14A comprises two separate side plates, one of which is shown at 60A, (the other side plate being similar and parallel to it) between which side plates the block 16A is adjustably disposed. A series of apertures 144 are provided in the side plates 60A along the same arcuate locus as the grooves 72, and are arranged to register with at least two of the apertures 140 at each of a number of alternative positions, so that bolts can be inserted through the registering apertures to clamp the side plates to the block in that position. In the embodiment shown, the apertures can be registered at 11°, 14°, 17°, 20° and 23° settings for the axis 26, as indicated by the relevant number appearing in the recess 74. This means that, since the range of settings marked on the block extend from 10° to 24°, it should be possible to find one of those five settings for the block which is not more than about 1° out from the most preferred setting. In practice, accuracy to within 1° in this setting is unlikely to be important, so that this simpler arrangement of FIGS. 6 and 7 may be a perfectly satisfactory alternative to the more complex and therefore more expensive arrangement of FIGS. 1 to 4. It will be noted that, although the actual setting of the block relative to the bracket cannot be so finely adjusted, nevertheless the actual value of that setting is precisely known, so that the lie angle for the handle can be accurately determined.

As well as sacrificing fineness of setting for the axis 26 in the arrangement of FIGS. 6 and 7, it will also be observed that there is no means provided for varying the vertical setting of the bracket 14A. It is anticipated that the bracket will be firmly secured, through apertures 150 in the base of the bracket, to a supporting surface at the desired height for the user of the equipment, and thus the equipment will be especially set up for him and would not then be expected to suit most other potential users. This simpler arrangement is therefore more suitable for individual purchasers of the equipment, whereas the more complex equipment of FIGS. 1 to 4 is more suitable for practice by a variety of different users. However, the side plates of the bracket 14A could be secured by bolts to a pair of vertical channels mounted on the support surface, so that the bracket could be vertically adjusted.

In order to determine the correct height for mounting the bracket 14A, the purchaser of such equipment will normally be introduced to one of the more complex constructions of FIGS. 1 to 4, and that equipment set up for his individual characteristics. In that condition, the height of the bracket 14 can be read by means of the mark 127 on the bracket against the scale 129. A similar mark 127 is provided on the bracket 14A, so that the purchaser can then secure his bracket 14A at the same height as the bracket 14.

I claim:

1. An improved golf swing simulator device of the kind which comprises a handle or mounting for a handle representing that of a golf club, attachment means for mounting the device to a stationary support, and a linkage connecting the handle with the attachment means, the linkage comprising an arm pivotally mounted at one end to the attachment means about a first axis, the arm extending away from said axis so that on pivoting the other end of the arm describes a circle about said first pivot axis, a crank one end of which is connected with said other end of the arm through a pivotal connection having a second axis of rotation spaced from said first axis, and the other end of which is rotatably mounted to the handle about the longitudinal axis of the handle so that the handle projecting from the crank is spaced from said pivotal connection in line with said second axis, means for adjusting the effective length of the arm, means for adjustment of the angle that said first pivot axis makes with the horizontal, and means whereby the angle between said first and second axes can be adjusted; wherein the improvement is characterised in that the means whereby the angle between said first and second axes can be adjusted is adapted to act about a centre which is in the region of the handle.

2. An improved golf swing simulator device according to claim 1 wherein said centre of adjustment is on the longitudinal axis of the handle.

3. An improved golf swing simulator device of the kind which comprises a handle or mounting for a handle representing that of a golf club, attachment means for mounting the device to a stationary support, and a linkage connecting the handle with the attachment means, the linkage comprising an arm pivotally mounted at one end to the attachment means about a first axis, the arm extending away from said axis so that on pivoting the other end of the arm describes a circle about said first pivot axis, a crank one end of which is connected with said other end of the arm through a pivotal connection having a second axis of rotation spaced from said first axis and the other end of which is rotatably mounted to the handle about the longitudinal axis of the handle so that the handle projecting from the crank is spaced from said pivotal connection in line with said second axis, means for adjusting the effective length of the arm, means for adjustment of the angle that said first pivot axis makes with the horizontal, and means whereby the angle between said first and second axes can be adjusted; wherein the improvement is characterised in that said attachment means comprises a first component for fixing to the stationary support and a second component vertically adjustably mounted to said first component and to which said arm is pivoted, a first upright scale on one of said components representing the standing height of the club, a second upright scale on the other of said components alongside the first scale being proportional to and representing the user's own effective arm measurement, said arm of the simulator being also provided with a lengthwise scale proportional to and representing the user's own effective arm measurement; whereby in setting up the simulator for use said second component is adjusted on said first component so that the reading representing the desired club standing height and the reading representing the user's own effective arm length are coincident on said first and second scales, and the effective length of the simulator arm is adjusted to the reading on said arm scale representing the user's own effective arm length.

4. An improved golf swing simulator device of the kind which comprises a handle or mounting for a handle representing that of a golf club, attachment means for mounting the device to a stationary support, and a linkage connecting the handle with the attachment means, the linkage comprising an arm pivotally mounted at one end to the attachment means about a first axis, the arm extending away from said axis so that on pivoting the other end of the arm describes a circle about said first pivot axis, a crank one end of which is connected with said other end of the arm through a pivotal connection having a second axis of rotation spaced from said first axis, and the other end of which is rotatably mounted to the handle about the longitudinal axis of the handle so that the handle projecting from the crank is spaced from said pivotal connection in line with said second axis, means for adjusting the effective length of the arm, means for adjustment of the angle that said first pivot axis makes with the horizontal, and means whereby the angle between said first and second axes can be adjusted; wherein the improvement is characterised in that a first angle scale indicates the angle setting of the first axis, a second angle scale indicates the angle setting of the second axis, the two angle scales being arranged so that for a given lie angle of the club the difference between their respective readings is constant irrespective of the actual angle settings of the first and second axes, said difference representing an angle index value for that lie angle, whereby on setting up the simulator for use, the first axis is adjusted to a desired angle setting, the index value for the desired lie angle is added to or subtracted from the reading of the first angle scale, and the second axis is adjusted to show the resultant value on the second angle scale.

5. An improved golf swing simulator device of the kind which comprises a handle or mounting for a handle representing that of a golf club, attachment means for mounting the device to a stationary support, and a linkage connecting the handle with the attachment means, the linkage comprising an arm pivotally mounted at one end to the attachment means about a first axis, the arm extending away from said axis so that on pivoting the other end of the arm describes a circle about said first pivot axis, a crank one end of which is connected with said other end of the arm through a pivotal connection having a second axis of rotation spaced from said first axis, and the other end of which is rotatably mounted to the handle about the longitudinal axis of the handle so that the handle projecting from the crank is spaced from said pivotal connection in line with said second axis, means for adjusting the effective length of the arm, means for adjustment of the angle that said first pivot axis makes with the horizontal, and means whereby the angle between said first and second axes can be adjusted; wherein the improvement is characterised in that the means for mounting the device to a stationary support comprises a bracket adapted to be secured directly or indirectly to a said support, and a block adjustably mounted on the bracket, the block and the bracket each having a series of holes each series disposed along a simular arcuate locus, the holes being arranged so that at least two holes of the block and two holes of the bracket are coincident at each of a number of different angular settings for the block relative to the bracket, whereby the block can be secured to the bracket at any of said positions by passing a pair of bolts or the like through the registering holes.

6. An improved golf swing simulator device according to claim 5 wherein the bracket comprises two separate side plates which are clamped on either side of the block by said bolts.

7. An improved golf swing simulator device of the kind which comprises a handle or mounting for a handle representing that of a golf club, attachment means for mounting the device to a stationary support, and a linkage connecting the handle with the attachment means, the linkage comprising an arm pivotally mounted at one end to the attachment means about a first axis, the arm extending away from said axis so that on pivoting the other end of the arm describes a circle about said first pivot axis, a crank one end of which is connected with said other end of the arm through a pivotal connection having a second axis of rotation spaced from said first axis, and the other end of which is rotatably mounted to the handle about the longitudinal axis of the handle so that the handle projecting from the crank is spaced from said pivotal connection in line with said second axis, means for adjusting the effective length of the arm, means for adjustment of the angle that said first pivot axis makes with the horizontal, and means whereby the angle between said first and second axes can be adjusted; wherein the improvement is characterised in that the means for mounting the device to the stationary support comprises a channel-shaped bracket adapted for mounting to a said support and a block adjustably disposed within the bracket and pivotally carrying said arm, the sides of the block being provided with arcuate grooves and the sides of the channel being provided with mutually inwardly directed projections which engage the grooves so as to guide the adjustment of the block relative to the bracket along an arcuate path, one side member of the bracket being movable towards and away from the opposite side member of the bracket, and means being provided for effecting such movement whereby the block can be alternatively clamped and released within the bracket.

* * * * *